United States Patent [19]

Ito et al.

[11] Patent Number: 5,066,934

[45] Date of Patent: Nov. 19, 1991

[54] METHOD OF ADJUSTING A FREQUENCY RESPONSE IN A STRIPLINE FILTER DEVICE

[75] Inventors: Kenji Ito; Hiroyuki Shimizu; Naomasa Wakita, all of Nagoya, Japan

[73] Assignee: NGK Spark Plug Co., Ltd., Aichi, Japan

[21] Appl. No.: 639,352

[22] Filed: Jan. 10, 1991

[30] Foreign Application Priority Data

Jan. 12, 1990 [JP] Japan ..... 2-5552

[51] Int. Cl.[5] ..... H01P 1/203

[52] U.S. Cl. ..... 333/205; 333/204; 333/235

[58] Field of Search ..... 333/202, 205, 219, 235, 333/246, 238

[56] References Cited

U.S. PATENT DOCUMENTS 4,157,517 6/1979 Kneisel et al. ..... 333/205
4,523,162 6/1985 Johnson ..... 333/204 X
4,975,664 12/1990 Ito et al. ..... 333/205

*Primary Examiner*—Eugene R. LaRoche
*Assistant Examiner*—Seung Ham
*Attorney, Agent, or Firm*—Larson & Taylor

[57] ABSTRACT

A method of adjusting a frequency response in a stripline filter device having a pair of stacked dielectric substrates with a plurality of stripline resonator conductors being sandwiched therebetween, wherein the frequency adjusting is performed for each resonator conductor under the condition that the resonator conductor(s) adjacent to one to be determined is electrically connected via a fine strip member to the ground layer, thereby correctly tuning the frequency response of each resonator conductor without any influence of the other resonator conducting layers.

6 Claims, 6 Drawing Sheets

METHOD OF ADJUSTING A FREQUENCY RESPONSE IN A STRIPLINE FILTER DEVICE

BACKGROUND OF THE INVENTION

The present invention relates to a method of adjusting a frequency response in a stripline filter device which may be used as a band-pass filter for example.

Such a stripline filter device is known, which is utilized as a band-pass filter for a microwave range. An example of such a conventional stripline filter device is illustrated in FIG. 1. As will be seen in FIG. 1, it comprises a lower dielectric substrate 1 and an upper dielectric substrate 2 which are stacked to each other. Each of the dielectric substrates 1 and 2 may be of dielectric ceramic material having a high dielectric constant and a lower dielectric loss such as $BaO—TiO_2$, $BaO—TiO_2$-rare earth or the like. The lower dielectric substrate I is provided with an external ground conducting layer 3 on the peripheral portion and bottom surface thereof. Similarly, the upper dielectric substrate 2 is provided with an external ground conducting layer 4 on the peripheral portion and upper surface thereof. On the upper surface of the lower dielectric substrate 1 are disposed a plurality of stripline resonator conducting layers 5, 6 and 7 which form a filter element. Each resonator conducting layer has one end or an open circuit end (5*a*, 6*a* and 7*a*) spaced from the ground conducting layer 3 and the other end or a short circuit end (5*b*, 6*b* and 7*b*) connected to the ground conducting layer 3. The open circuit ends 5*a*, 6*a* and 7*a* of the respective resonator conducting layers 5, 6 and 7 are alternately disposed so as to form an interdigitated configuration. The upper dielectric substrate 2 is fixed on the lower dielectric substrate 1, and the ground conducting layers 3 and 4 of the respective dielectric substrates are connected to each other.

As well known in the art, the filter device of this type has a frequency response which depends on the configuration and dielectric constant of the substrates, and the dimension of the resonator conductors. Upon the manufacturing of the filter device the dielectric constant Of the substrates and the size of the resonator conducting layers are strictly determined. However, it can not be avoided that there may occur any dispersions in the dielectric constant of the substrates and in the dimension of the resonator conducting layers. It is, therefore, necessary to adjust the frequency response of the filter device after being completed.

The adjustment of the frequency response can not be performed by adjusting the length of the resonator conducting layers because they are embedded in the dielectric substrates. One solution to this problem has been proposed in U.S. Pat. No. 4,157,517. According to the adjusting method disclosed in this U.S. patent, the frequency of the filter is previously set at a lower level than a desired one, and the external conductor or ground conducting layer provided on the upper surface of the upper substrate is partially removed at regions adjacent the open circuit ends of the resonator conducting layers to reduce the capacitance between the external conducting layer and the respective resonator conducting layers and to increase the response frequency of the filter thereby making it possible to adjust the frequency.

This previously proposed adjusting method are extremely useful for the frequency response characteristic of the stripline filter device. However, as the number of the resonator conducting layers to be provided is increased, the frequency response characteristics of the respective resonator conducting layers intricately interact with each other, thus involving much difficulty for individually discerning and properly adjusting each frequency response characteristic.

SUMMARY OF THE INVENTION

It is therefore an object of the present invention to provide a method of adjusting a frequency response of a stripline filter device in which the frequency response characteristics of respective resonator conducting layers can be individually discerned and can be properly adjusted.

Another object of the invention is to provide a stripline filter device assembled by using the frequency response adjusting method according to present invention.

According to one aspect of the present invention, there is provided a method of adjusting a frequency response of a stripline filter device which comprises a pair of dielectric substrates each having a peripheral and outer surfaces provided with an external ground conducting layer, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, wherein it comprises the steps of electrically connecting the open circuit end of one or more specific resonator conducting layers to the external ground conducting layer on the peripheral surface of each substrate by means of a fine strip member, assembling the dielectric substrate with the resonator conducting layers therebetween, adjusting the frequency response characteristics of the resonator conducting layers provided with no fine strip member at the open circuit ends thereof, and then adjusting sequentially the frequency response characteristics of the resonator conducting layers each provided with the fine strip member by disconnecting the associated fine strip member so as to separate the open circuit ends from the external ground conducting layer.

By electrically connecting the open circuit ends of the specific resonator conducting layers to the external ground conducting layer via fine strip members, each of these resonator conducting layers respectively has no longer resonator function and then will act as an electrical barrier.

With the method of the present invention, firstly, one adjusts the frequency response characteristics of the resonator conductor layers whose open ends are not connected to the external ground conducting layer via the fine strip members. In case all the resonator conductor layers are provided with the fine strip members for electrically connecting the open ends thereof to the external ground conducting layer, one cuts off the fine strip member from the desired resonator conductor layer and then adjusts the frequency response characteristic thereof. In this case, if the frequency is changed with result of the adjustment, the adjusted waveform of the resonator conductor layer is not affected by the adjacent resonator conductor layers because they have the fine strip members provided on the open ends thereof and the will function as the electrical barriers.

This in turn allows a frequency response characteristic to be properly adjusted. The adjustment of the frequency of each resonator conductor layer may be carried out by removing partially the ground conducting layer on each substrate as is conventionally known.

In this way, by sequentially removing the fine strip members provided on the open ends of the respective resonator conductor layers and adjusting the frequency response characteristics thereof, it is possible to tune the filter device for a desired frequency response.

According to a second aspect of the present invention, there is provided a stripline filter device comprising a pair of dielectric substrates having a peripheral and outer surfaces an external ground conducting layer provided on the peripheral and outer surfaces of said each dielectric substrate, a plurality of stripline resonator conducting layers sandwiched between said dielectric substrates, each resonator conducting layer having a short circuit end connected to said ground conducting layer on one lateral surface of said each substrate and an open circuit end spaced from said ground conducting layer on the opposite lateral surface of said each substrate, and a fine strip member for electrically connecting the open circuit end of at least one of said resonator conducting layers with the external ground conducting layer, each fine strip member being disconnected when the frequency response of the resonator conducting layer associated therewith is adjusted.

The present invention will now be described by way of example with reference to the accompanying drawings.

DETAILED DESCRIPTION

Figure 1:
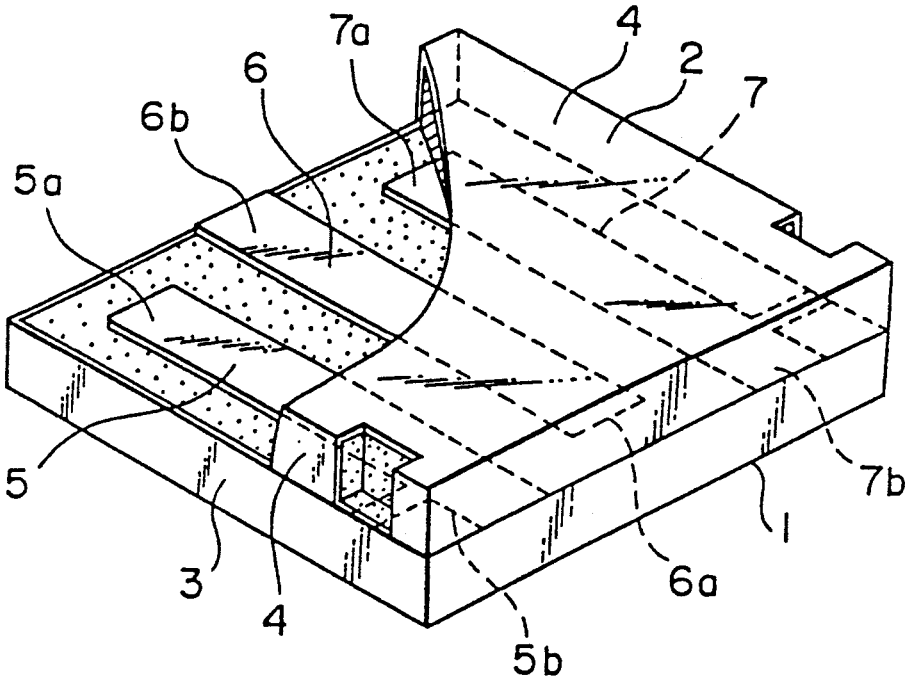
FIG. 1 PRIOR ART
FIG. 1 is a perspective partially cutaway view showing a conventional three-conductor type filter device.
Figure 2:
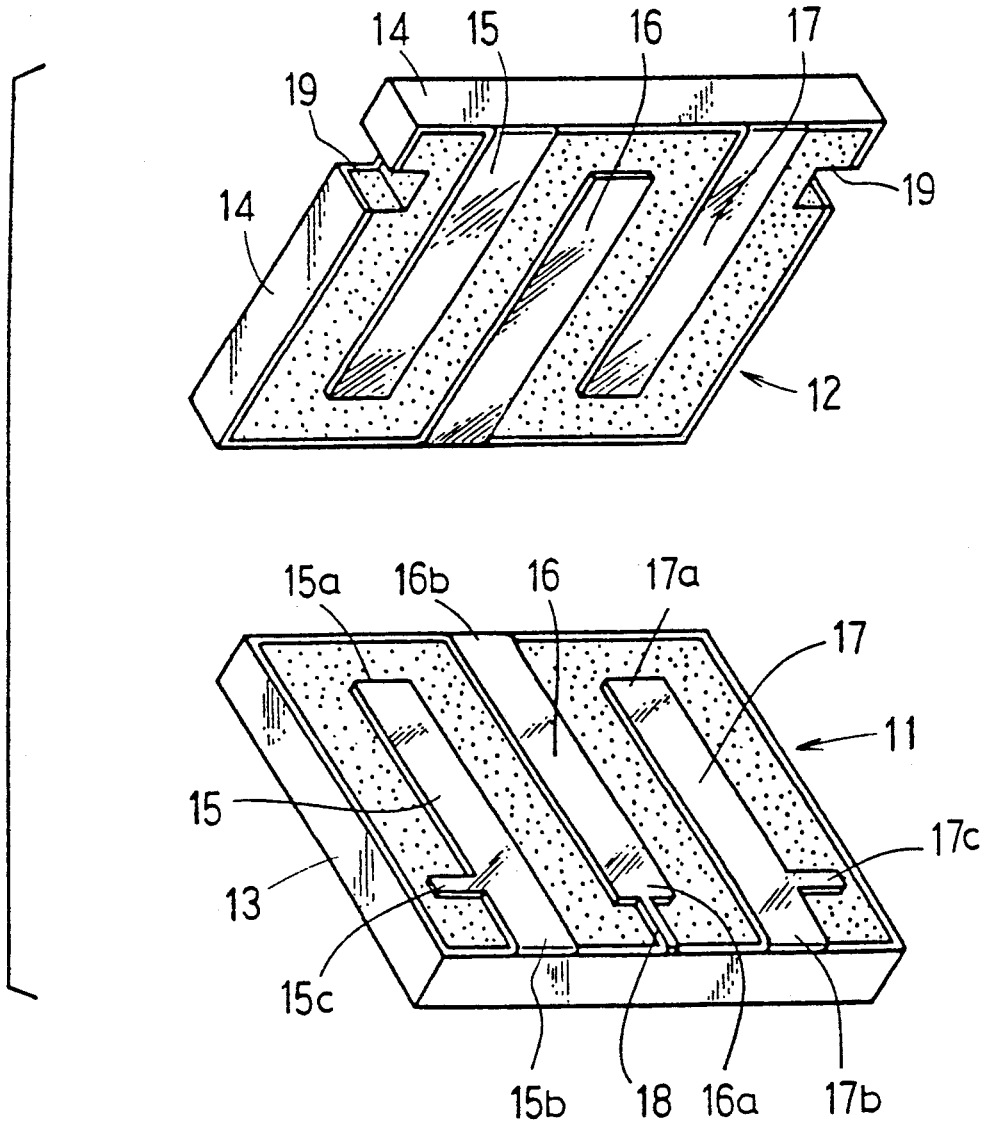
FIG. 2 is an exploded perspective view schematically showing a filter device prior to frequency response adjustment in accordance with the present invention.
Figure 3:
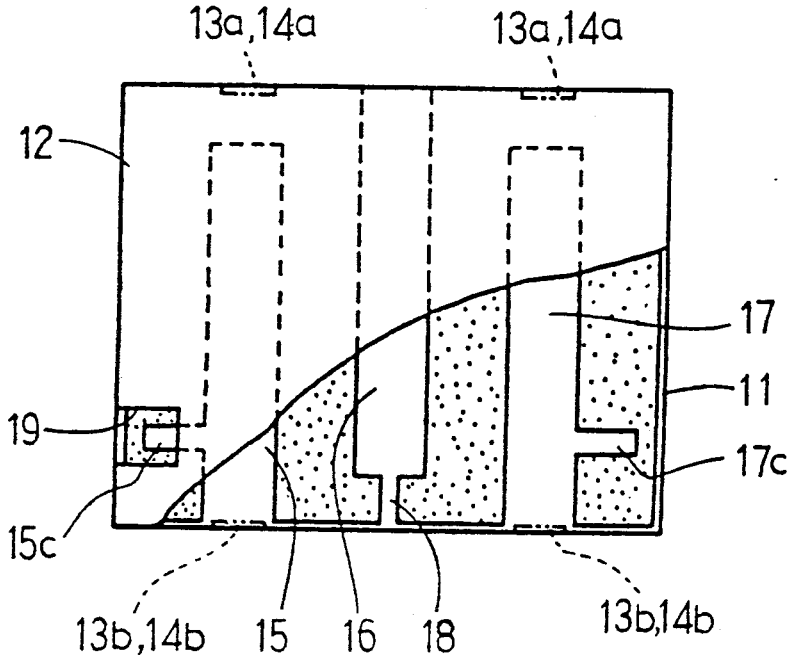
FIG. 3 is a partially cutaway plan view showing the filter device of FIG. 2 when being assembled.

FIGS. 2 and 3 show a stripline filter for which the present invention is applied.

The illustrated filter comprises a lower and upper dielectric substrates 11 and 12 which are stacked to each other upon the assembling of the filter. Each of the dielectric substrates 11 and 12 may be of dielectric ceramic material having a high dielectric constant and a lower dielectric loss such as $BaO—TiO_2$, $BaO—TiO_2$-rare earth or the like. The lower dielectric substrate 11 is provided with an external ground conducting layer 13 on the peripheral portion and outer surface thereof. Similarly, the upper dielectric substrate 12 is provided with an external ground conducting layer 14 on the peripheral portion and upper or outer surface thereof.

On the upper or inner surface of the lower dielectric substrate 11 are provided a plurality of stripline resonator conducting layers 15, 16 and 17 which form a filter element of an interdigital type. Each resonator conducting layer has one end or an open circuit end (15*a*, 16*a* and 17*a*) spaced from the ground conducting layer 13 and the other end or a short circuit end (15*b*, 16*b* and 17*b*) connected to the ground conducting layer 13. The open circuit ends 15*a*, 16*a* and 17*a* of the respective resonator conducting layers 15, 16 and 17 are alternately disposed so as to form an interdigital type resonator.

The resonator conducting layers 15 and 17 have lateral extensions 15*c* and 17*c*, respectively. These lateral extensions 15*c* and 17*c* is connected to signal terminals not shown, respectively.

The open circuit end 16*a* of the resonator conducting layers 16 is temporally and electrically connected to the ground conducting layer 13 via a fine strip member 18. This fine strip member 18 is so constructed that it can be easily removed at a frequency adjusting procedure and does not affect the characteristic of the resonator conducting layers 16.

Similarly, on the lower or inner surface of the upper dielectric substrate 12 may also be provided a plurality of stripline resonator conducting layers 15, 16 and 17 which are disposed to have a reflected image relation with respect to the resonator conducting layers 15, 16 and 17 on the lower dielectric substrate 11. When being assembled the resonator conducting layers 15, 16 and 17 on the lower dielectric substrate 11 becomes into face-to-face contact with those on the upper dielectric substrate 12 without occurring any gaps between the lower dielectric substrate 11 and the upper dielectric substrate 12. The ground conducting layers 13 and 14 of the respective dielectric substrates are connected to each other.

The upper dielectric substrate 12 is also provided with recesses or notches 19 through which the lateral extensions 15*c* and 17*c* on the lower dielectric substrate 11 are extended so that they are prevented from bring into contact with the external ground conducting layers 13 and 14.

With the filter device thus constructed, it is substantially unavoidable that there may occur any deviations in the dielectric constants of the used substrates and/or in the dimension of the resonator conducting layers upon the manufacturing, which results in that the frequency response of the completed filter may be deviated from an intended one. Therefore, the frequency response of the filter should be adjusted when being completed.

Figure 5:
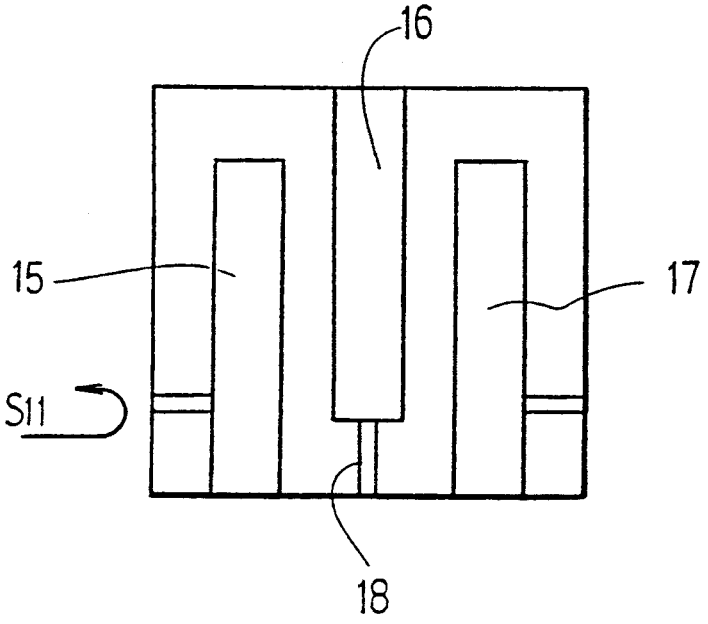
FIG. 5 is an explanation view showing the first step of frequency adjusting procedures in accordance with the present invention.
Figure 6:
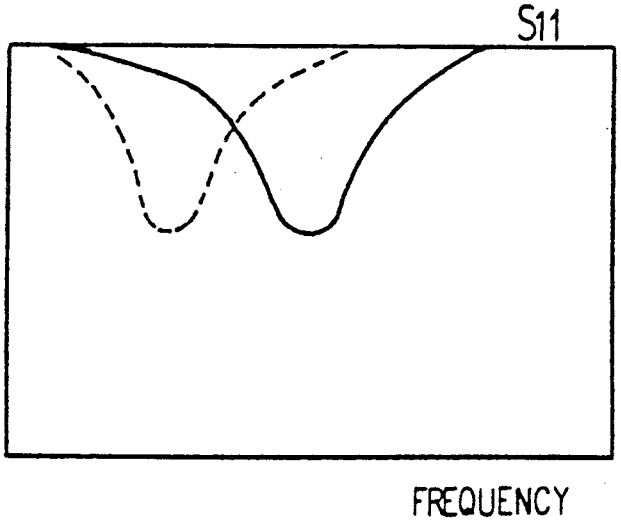
FIG. 6 is a graph showing a signal wave form which corresponds to the condition shown in FIG. 5.

As shown in FIG. 5, firstly a reflection characteristic signal having a waveform S11 from the resonator conducting layer 15 is measured via the lateral extension 15*c*. As shown in FIG. 6, if the measured waveform S11 (shown by a dotted line) is different from a predetermined value (shown by a solid line), the adjustment is then carried out for that resonator conducting layer 15 in such a manner that the waveform S11 can be corrected into the curve shown by the solid line. This adjustment can be done by removing partially the external ground conducting layers 13 and 14 on the substrates 11 and 12.

That is, if the measured waveform S11 has a center frequency lower than the desired one as shown in FIG. 6, the external ground conducting layer provided on the peripheral surface of each substrate is partially removed at a portion (13*a* and 14*a*) which corresponds to the open circuit end 15*a* of the resonator conducting layer 15 so as to shift the center frequency toward a higher frequency zone. Contrarily if the center frequency of the measured waveform S11 is higher than the desired one the external ground conducting layer may be partially removed at a portion (13*b* and 14*b*) which corresponds to the short circuit end 15*b* of the resonator conducting layer 15 so as to shift the center frequency toward a lower frequency zone.

During this frequency adjusting procedure for the resonator conducting layer 15, the open circuit end 16*a* of the central resonator conducting layer 16 is held being connected to the external ground conducting layers 13 and 14 via the fine strip member 18, and thus, the central resonator conducting layer 16 functions as an electrical barrier. As a result, the waveform of the frequency response characteristic of the resonator conducting layer 15 can be prevented from being subjected to any influence of the central resonator conducting layer 16 and the other side resonator conducting layer 17. In consequence, there can be obtained a genuine waveform for the resonator conducting layer 15, and thus, the frequency response characteristic of the resonator conducting layer 15 can be correctly performed.

Figure 7:
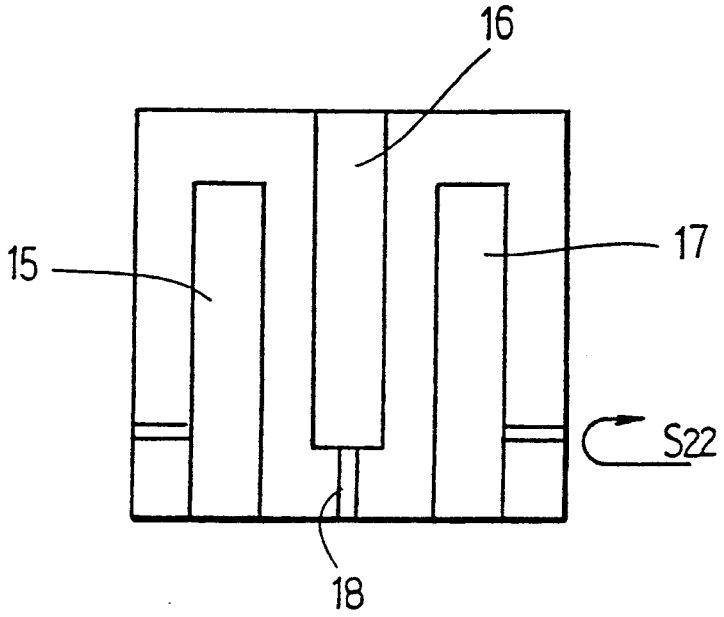
FIG. 7 is an explanation view showing the second step of the frequency adjusting procedures in accordance with the present invention.
Figure 8:
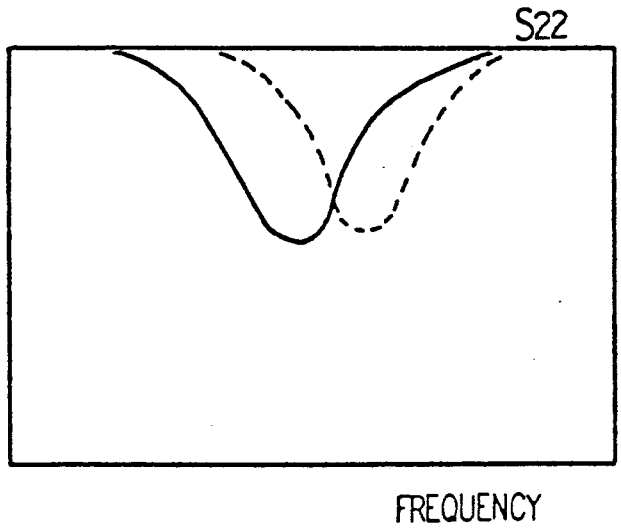
FIG. 8 is a graph showing a signal wave form which corresponds to the condition shown in FIG. 7.

Next, as shown in FIG. 7, there is measured waveform S22 of a reflection characteristic signal from the resonator conducting layer 17 via the lateral extension 17*c*, and then the adjustment of the frequency characteristic therefor is performed in the same way as described hereinbefore so that the measured waveform S22 becomes identical with the desired one shown by a solid line in FIG. 8.

Figure 4:
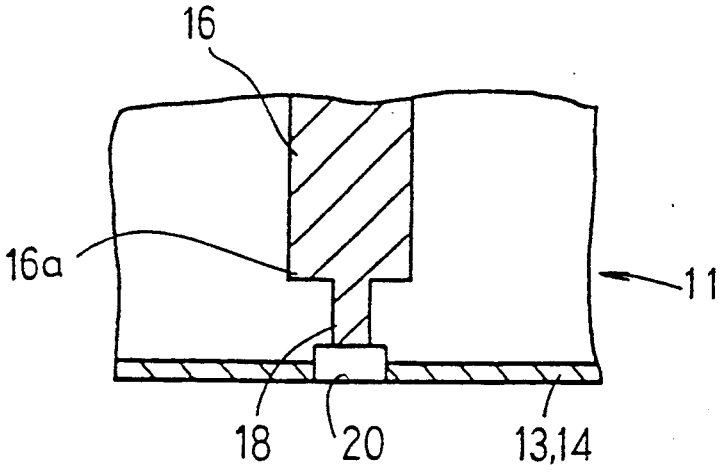
FIG. 4 is an enlarged plan view showing how a fine strip member on a resonator conductor layer in the filter device of FIG. 2 is removed in accordance with the present invention.
Figure 9:
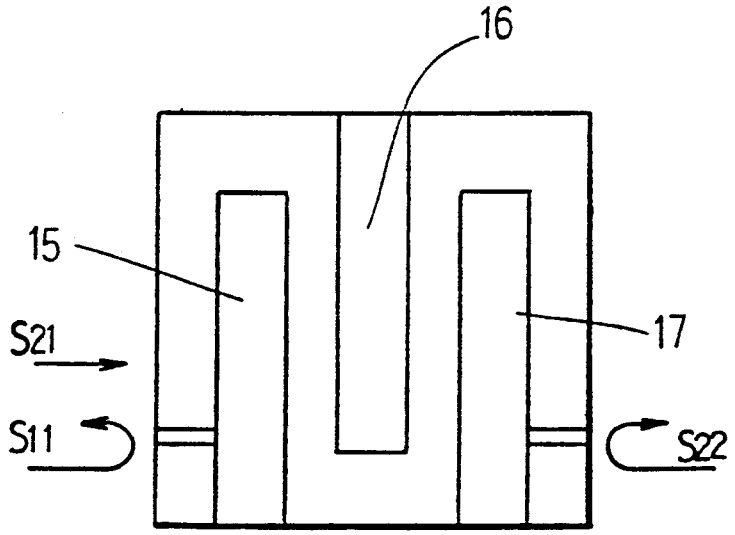
FIG. 9 is an explanation view showing the final step of the frequency adjusting procedures in accordance with the present invention.
Figure 10:
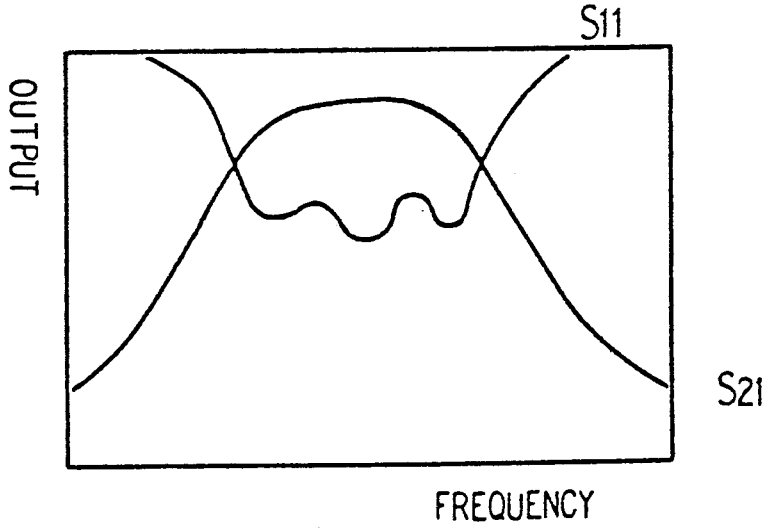
FIG. 10 is a graph showing signal wave forms which corresponds to the condition shown in FIG. 9.

Then, as shown in FIG. 4 through the external ground conducting layers 13 and 14 a hole 20 is provided at the portion corresponding to one end of the fine strip member 18, thereby cutting off it. As a result, there can be materialized the state shown in FIG. 9, in which a reference numeral S21 designates a transmission characteristic of the filter. The hole 20 may be provided by means of a laser beam trimming or a rotary whetstone.

Finally, again one measures the reflection characteristic signal waveform S11 or S22, and then properly adjusts the resonance frequency characteristic of the central resonator conducting layer 16 in the same manner as described in the above. In this connection, since the adjustment has already been performed for the resonator conducting layers 15 and 17 on both sides, readjustment therefor is not needed at all.

In this way, the filter can be tuned to a desired frequency response.

With the illustrated arrangement, the upper dielectric substrate 12 is provided with recesses or notches 19 for preventing the lateral extensions 15*c* and 17*c* from bring into contact with the external ground conducting layers 13 and 14. However, these recesses 19 may be omitted if the lateral extensions 15*c* and 17*c* are extended so that they do not make contact with the external ground conducting layers 13 and 14.

Further, the resonator conducting layers on the upper dielectric substrate 12 may be omitted if necessary.

Furthermore, the stripline pattern of the resonator conducting layers 15, 16 and 17 may be formed as a comb type in which the open circuit ends and the short circuit ends thereof are disposed at the same sides, respectively. In that case, the centrally positioned resonator conducting layer should be connected via the fine strip member to the external ground conducting layer.

The above description has merely referred to the stripline filter device having three resonator conducting layers as an embodiment of the present invention. It should be however understood that the scope of the invention is not confined to the number of available resonator conducting layers.

If the stripline filter is provided with a pair of resonator conducting layers, then the open circuit end of one of these two resonator conducting layers remains being connected with the external ground conducting layer via a fine strip member. In that case, after adjusting the frequency characteristic of the other resonator conducting layer, the fine strip member provided on the open circuit end of one resonator conducting layer can be cut off and then the frequency adjustment can be performed for this resonator conducting layer.

Furthermore, if there is provided a stripline filter device which comprises four or more resonator layers, it is possible to preliminarily provide all the resonator layers with fine strip members, and frequency adjustment for each resonator layer may be sequentially performed by cutting off the associated fine strip member.

As described above, according to the present invention the frequency adjusting is performed for each resonator line under the condition that the resonator conductor(s) adjacent to one to be determined is electrically connected via the fine strip member to the ground layer, and thus the present invention has an advantage that during the frequency adjusting for each resonator line there can be avoided any influence of the other resonator conductor(s).

Further, the present invention has also an advantage that it is possible to easily and correctly tune the frequency response of the filter device even if the number of the resonator lines is increased.

It is to be understood that the present invention is not limited to the particular embodiments described and that numerous modifications and alterations may be made by those skilled in the art without departing from the spirit and scope of the invention.

We claim:

1. A method of adjusting a frequency response of a stripline filter device which comprises a pair of dielectric substrates each having a peripheral and outer surfaces provided with an external ground conducting layer, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, wherein the method comprises the steps of electrically connecting the open circuit end of one or more specific resonator conducting layers to the external ground conducting layer on the peripheral surface of each substrate by means of a fine strip member, assembling the dielectric substrates with the resonator conducting layers therebetween, adjusting the frequency response characteristics of the resonator conducting layers provided with no fine strip member at the open circuit ends thereof, and then adjusting sequentially the frequency response characteristics of the resonator conducting layers each provided with the fine strip member by disconnecting the associated fine strip member so as to separate the open circuit ends from the external ground conducting layer.

2. A method as claimed in claim 1, wherein the disconnecting of each of the fine strip members is performed by forming a hole at a portion of the ground conducting layer which corresponds to one end of the fine strip member.

3. A method of adjusting a frequency response of a stripline filter device which comprises a pair of dielectric substrates each having a peripheral and outer surfaces provided with an external ground conducting layer, and a plurality of stripline resonator conducting layers sandwiched between the dielectric substrates, each resonator conducting layer having a short circuit end connected to the ground conducting layer on one lateral surface of each substrate and an open circuit end spaced from the ground conducting layer on the opposite lateral surface of each substrate, wherein the method comprises the steps of electrically connecting the open circuit ends of all of the resonator conducting layers to the external ground conducting layer on the peripheral surface of each substrate by means of fine strip members, assembling the dielectric substrates with the resonator conducting layers therebetween, and then adjusting sequentially the frequency response characteristics of the resonator conducting layers by disconnecting the associated fine strip member so as to separate the open circuit end from the external ground conducting layer.

4. A method as claimed in claim 3, wherein the disconnecting of each of the fine strip members is performed by forming a hole at a portion of the ground conducting layer which corresponds to one end of the fine strip member.

5. A stripline filter device comprising a pair of dielectric substrates having a peripheral and outer surfaces; an external ground conducting layer provided on the peripheral and outer surfaces of said each dielectric substrate; a plurality of stripline resonator conducting layers sandwiched between said dielectric substrates, each resonator conducting layer having a short circuit end connected to said ground conducting layer on one lateral surface of said each substrate and an open circuit end spaced from said ground conducting layer on the opposite lateral surface of said each substrate; and a fine strip member for electrically connecting the open circuit end of at least one of said resonator conducting layers with the external ground conducting layer, the fine strip member being disconnected when the frequency response of the resonator conducting layer associated therewith is adjusted.

6. A stripline filter device as claimed in claim 5, wherein each of said resonator conducting layer is connected to the external ground conducting layer via the associated fine strip member.

* * * * *